US009644428B2

(12) United States Patent
Schwefe

(10) Patent No.: US 9,644,428 B2
(45) Date of Patent: May 9, 2017

(54) DRILL BIT WITH A HYBRID CUTTER PROFILE

(75) Inventor: Thorsten Schwefe, Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 121 days.

(21) Appl. No.: 12/422,418

(22) Filed: Apr. 13, 2009

(65) Prior Publication Data

US 2010/0175930 A1 Jul. 15, 2010

Related U.S. Application Data

(63) Continuation-in-part of application No. 12/351,518, filed on Jan. 9, 2009, now abandoned.

(51) Int. Cl.
*E21B 10/43* (2006.01)

(52) U.S. Cl.
CPC ..... *E21B 10/43* (2013.01)

(58) Field of Classification Search
CPC ..... E21B 10/42; E21B 2010/425; E21B 10/43
USPC ..... 75/331, 431, 434; 175/331, 431, 434
See application file for complete search history.

(56) References Cited

U.S. PATENT DOCUMENTS

| | | | | |
|---|---|---|---|---|
| 4,351,401 | A * | 9/1982 | Fielder | 175/428 |
| 4,440,247 | A | 4/1984 | Sartor | |
| 4,593,777 | A | 6/1986 | Barr | |
| 4,932,484 | A | 6/1990 | Warren et al. | |
| 5,033,560 | A | 7/1991 | Sawyer et al. | |
| 5,178,222 | A | 1/1993 | Jones et al. | |
| 5,238,075 | A | 8/1993 | Keith et al. | |
| 5,531,281 | A * | 7/1996 | Murdock | 175/431 |
| 5,549,171 | A | 8/1996 | Mensa-Wilmot et al. | |
| 5,551,522 | A | 9/1996 | Keith et al. | |
| 5,582,261 | A | 12/1996 | Keith et al. | |
| 5,607,025 | A | 3/1997 | Mensa-Wilmot et al. | |
| 5,937,958 | A | 8/1999 | Mensa-Wilmot et al. | |
| 6,062,325 | A | 5/2000 | Taylor et al. | |
| 6,308,790 | B1 | 10/2001 | Mensa-Wilmot et al. | |
| 6,349,780 | B1 | 2/2002 | Beuershausen | |
| 6,564,886 | B1 | 5/2003 | Mensa-Wilmot et al. | |
| 6,568,492 | B2 * | 5/2003 | Thigpen et al. | 175/408 |
| 7,000,715 | B2 | 2/2006 | Sinor et al. | |
| 7,048,081 | B2 | 5/2006 | Smith et al. | |
| 7,624,818 | B2 * | 12/2009 | McClain et al. | 175/57 |
| 8,245,797 | B2 * | 8/2012 | Jurica et al. | 175/57 |
| 9,085,939 | B2 * | 7/2015 | McClain et al. | |
| 2006/0180356 | A1 | 8/2006 | Durairajan et al. | |
| 2008/0105466 | A1 | 5/2008 | Hoffmaster et al. | |
| 2008/0179108 | A1 | 7/2008 | McClain et al. | |

OTHER PUBLICATIONS

Canadian Intellectual Property Office (CIPO) Office Action, dated Jan. 10, 2013 for Application No. 2,758,348.

* cited by examiner

*Primary Examiner* — Michael Wills, III
(74) *Attorney, Agent, or Firm* — Cantor Colburn LLP

(57) ABSTRACT

A drill bit and method of making a drill bit. A bit body is provided having a plurality of blade profiles thereon. The blade profile includes a first plurality of cutting elements disposed on each blade such that at least one cutting element on a first section of each blade profile is offset relative to at least one cutting element on a second section of each blade profile. Lateral stability of the drill bit relative to a drill bit without an offset is increased.

12 Claims, 8 Drawing Sheets

DRILL BIT WITH A HYBRID CUTTER PROFILE

CROSS-REFERENCE TO RELATED APPLICATION

This application is a continuation-in-part of and takes priority from U.S. patent application Ser. No. 12/351,518, filed on Jan. 9, 2009, which is incorporated herein by reference in its entirety.

BACKGROUND INFORMATION

1. Field of the Disclosure

This disclosure relates generally to drill bits and systems for using the same for drilling wellbores.

2. Background of the Art

Oil wells (also referred to as "wellbores" or "boreholes") are drilled with a drill string that includes a tubular member carrying a drilling assembly (also referred to as a "bottom-hole assembly" or "BHA") having a drill bit attached to the bottom end thereof. The drill bit is rotated by rotating the drill string from a surface location and/or by a drilling motor (also referred to as the "mud motor") in the BHA to disintegrate the rock formation to drill the wellbore. One type of drill bit, referred to as the PDC bit. A PDC bit typically includes a number of blade profiles. Each blade profile typically includes a cone section, nose section and shoulder section, each such section having a number of cutters thereon. PDC bits are made with different blade profiles and often are categorized as low profile, medium profile and long profile bits. The low profile bits provide a higher rate of penetration and exhibit low stability (i.e., high lateral vibrations) compared to the medium profile bits, while the medium profile bits provide a higher rate of penetration and a lower stability compared to the long profile bits. Often the same bit is used to drill through different formations, such as sand (soft formation) and shale (hard formation), wherein it may be desirable to switch from a short profile bit to a medium profile or long profile bit when transitioning from a soft to hard formation or vice versa.

The disclosure herein provides an improved drill bit that possesses properties more useful for drilling through different formations.

SUMMARY

In one aspect, a drill bit is disclosed that in one embodiment may include: a blade; a first plurality of cutting elements on the blade defining a first cutter profile; a second plurality of cutting elements on the blade defining a second cutter profile, wherein the first and second cutter profiles are offset from each other. In aspects, the first and second cutter profiles may be offset inwardly or outwardly relative to each other.

In another aspect, a method of making a drill bit is disclosed, which in one embodiment may include: providing a bit body with a cutter profile having a first cutter section that is offset from a second cutter section.

Examples of certain features of a drill bit and methods of making and using the same are summarized rather broadly in order that the detailed description thereof that follows may be better understood. There are, of course, additional features of the apparatus and methods disclosed hereinafter that will form the subject of the claims appended hereto.

BRIEF DESCRIPTION OF THE DRAWINGS

The disclosure herein is best understood with reference to the accompanying drawings, in which like numerals have generally been assigned to like elements and in which.

DETAILED DESCRIPTION OF THE EMBODIMENTS

Figure 1:
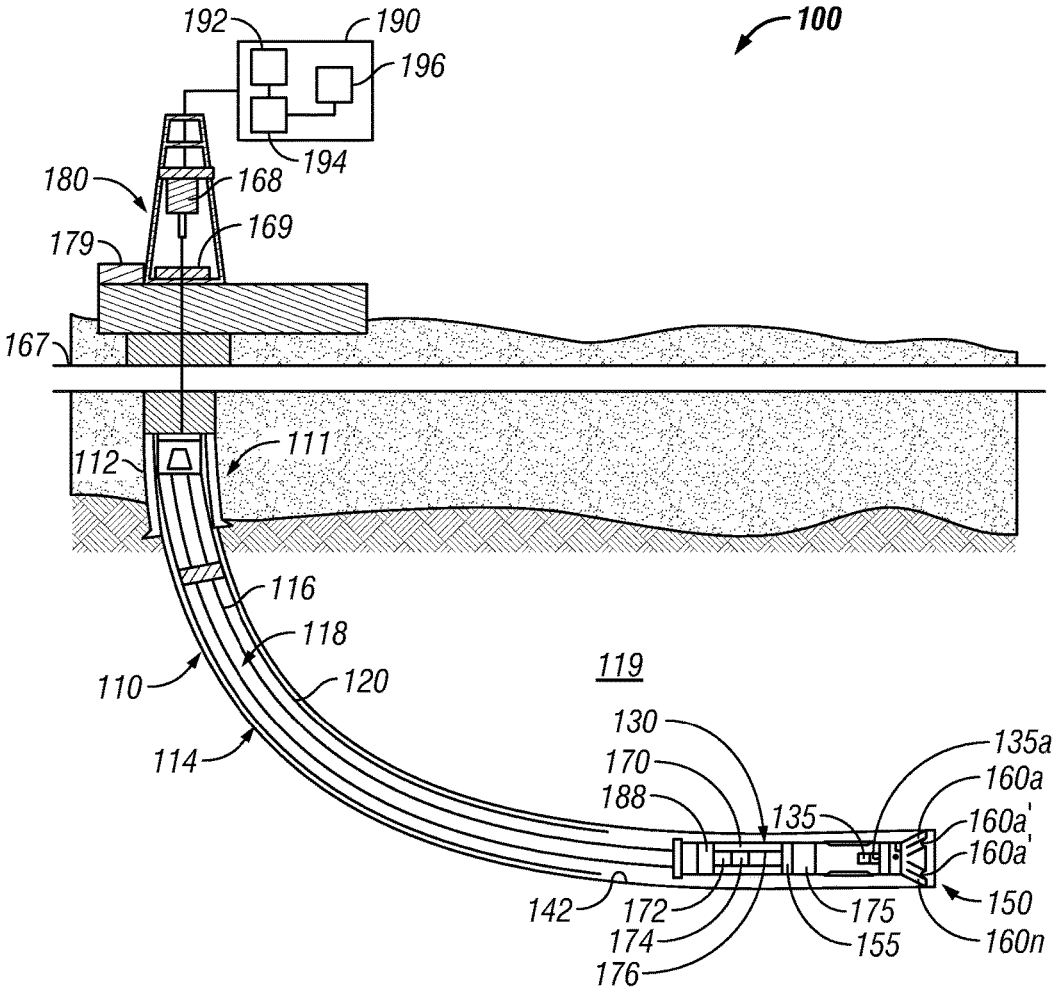
FIG. 1 is a schematic diagram of an exemplary drilling system that includes a drill string having a drill bit at an end thereof made according to one embodiment of the disclosure.

FIG. 1 is a schematic diagram of an exemplary drilling system 100 that may utilize drill bits made according to the disclosure herein. FIG. 1 shows a wellbore 110 having an upper section 111 with a casing 112 installed therein and a lower section 114 being drilled with a drill string 118. The drill string 118 is shown to include a tubular member 116 with a BHA 130 attached at its bottom end. The tubular member 116 may be a coiled-tubing or made by joining drill pipe sections. A drill bit 150 is shown attached to the bottom end of the BHA 130 for disintegrating the rock formation 119 to drill the wellbore 110 of a selected diameter.

Drill string 118 is shown conveyed into the wellbore 110 from a rig 180 at the surface 167. The exemplary rig 180 shown is a land rig for ease of explanation. The apparatus and methods disclosed herein may also be utilized with an offshore rig. A rotary table 169 or a top drive (not shown) coupled to the drill string 118 may be utilized to rotate the drill string 118 to rotate the BHA 130 and thus the drill bit 150 to drill the wellbore 110. A drilling motor 155 (also referred to as the "mud motor") may be provided in the BHA 130 to rotate the drill bit 150. The drilling motor 155 may be used alone to rotate the drill bit 150 or to superimpose the rotation of the drill bit 150 by the drill string 118. In one configuration, the BHA may include a steering unit 135 configured to steer the drill bit and the BHA along a selected direction. In one aspect, the steering unit may include a number of force application members 135*a* on a non-rotating sleeve which extends from a retracted position on a non-rotating sleeve to apply force on the wellbore inside. The force application members may be individually controlled to apply different amounts of force so as to steer the drill bit to drill a curved wellbore. Typically, vertical sections are drilled without activating the force application members 135*a*. Curved sections are drilled by causing the force application members 135*a* to apply different forces on the wellbore wall. The steering unit 135 may be used when the drill string comprises a drilling tubular (rotary drilling system) or coiled-tubing. Any other suitable directional drilling or steerable unit may be used for the purpose of this disclosure. A control unit (or controller) 190, which may be a computer-based unit, may be placed at the surface 167 to receive and process data transmitted by the sensors in the drill bit 150 and the sensors in the BHA 130, and to control selected operations of the various devices and sensors in the BHA 130. The surface controller 190, in one embodiment, may include a processor 192, a data storage device (or a computer-readable medium) 194 for storing data, algorithms and computer programs 196. The data storage device 194 may be any suitable device, including, but not limited to, a read-only memory (ROM), a random-access memory (RAM), a flash memory, a magnetic tape, a hard disk and an optical disk. During drilling, a drilling fluid 179 from a source thereof is pumped under pressure into the tubular member 116. The drilling fluid discharges at the bottom of the drill bit 150 and returns to the surface via the annular space (also referred as the "annulus") between the drill string 118 and the inside wall 142 of the wellbore 110.

Still referring to FIG. 1, the drill bit 150 may include one or more blade profiles that include offset cutters on a selected section of such blade profiles, 160*a*-160*n* as described in more detail in reference to FIGS. 2-7. The BHA 130 may include one or more downhole sensors (collectively designated by numeral 175) for providing measurement relating to one or more downhole parameters. The sensors 175 may include, but not be limited to, sensors generally known as the measurement-while-drilling (MWD) sensors or the logging-while-drilling (LWD) sensors, and sensors that provide information relating to the behavior of the drill bit 150 and BHA 130, such as drill bit rotation (revolutions per minute or "RPM"), tool face, pressure, vibration, whirl, bending, stick-slip, vibration, and oscillation. The BHA 130 may further include a downhole control unit (or controller) 170 configured to control the operation of the BHA 130, to at least partially process data received from the sensors 175, and to establish a bi-directional communication with a surface controller 190 via a two-way telemetry unit 188. The controller 170, in aspects, includes a processor 172, such as a microprocessor, for processing data from the sensors in the BHA and the drill bit and for providing information about one or more drill bit parameters, such as vibration, oscillation, stick slip and whirl, a data storage device 174, such as a memory device, and programs 176 containing instructions accessible to the processor 172.

Figure 2:
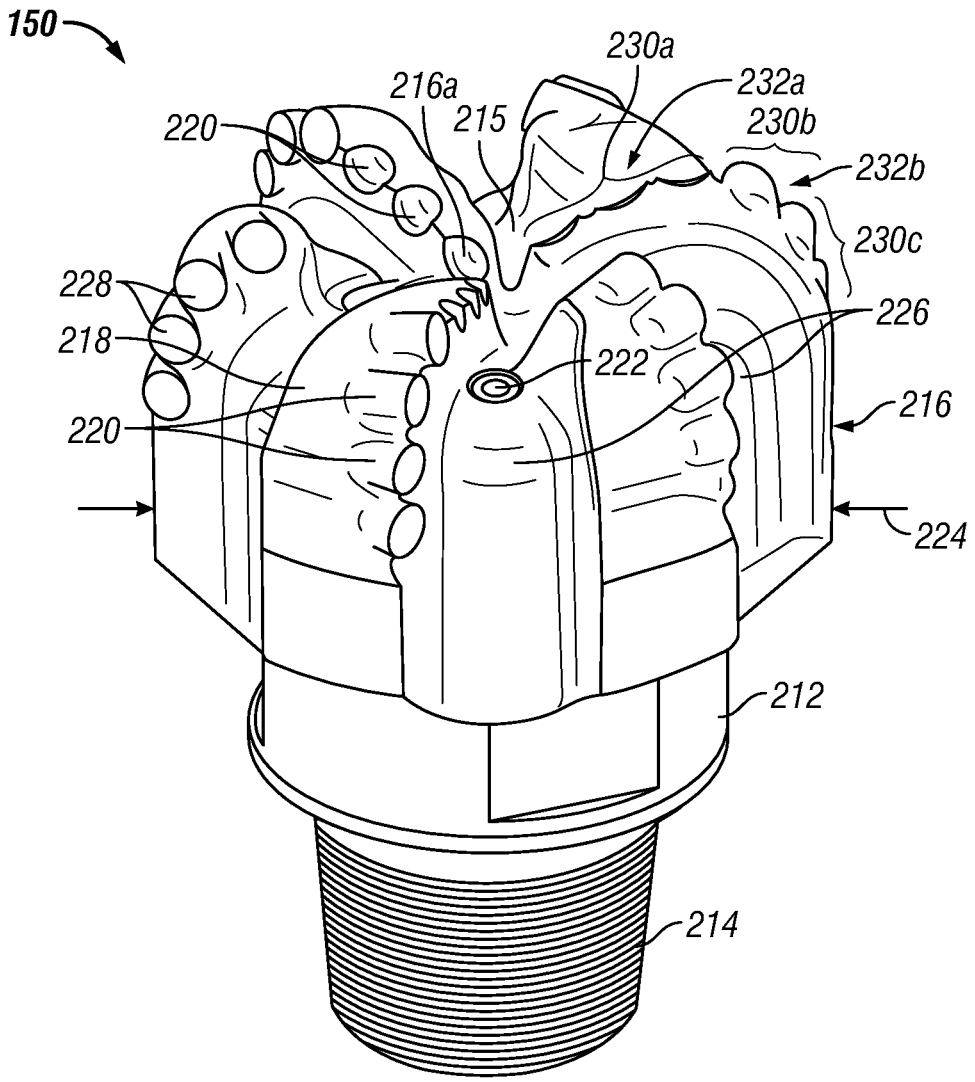
FIG. 2 is an isometric view of an exemplary drill bit showing cutters on a blade profile, made according to one embodiment of the disclosure, that may be used in a drilling assembly, such as shown in FIG. 1.

FIG. 2 shows an isometric view of the drill bit 150 made according to one embodiment of the disclosure. The drill bit 150 shown is a PDC bit that includes a bit body 212 having a conventional pin end 214 to provide a threaded connection for connecting to the BHA 130 (FIG. 1). The conventional pin end 214 may optionally be replaced with various alternative connection structures known in the art. The drill bit 150, and components thereof may be similar to those disclosed in U.S. Pat. No. 7,048,081, assigned to the assignee of this application, which patent is incorporated herein in its entirety by reference. The drill bit 150 shown includes a plurality of blades or blade profiles 216, each such blade having a forward facing surface or face 218. The drill bit 150 may have anywhere from two to sixteen blades 16. In one aspect, the face 218 may be substantially flat, concave and/or convex. The drill bit 150 also includes a row of cutters, or cutting elements 220 secured to the blades 216. The drill bit 150 also includes a plurality of nozzles 222 to distribute drilling fluid to cool and lubricate the drill bit 150 and to remove cuttings. The gage 224 has the maximum diameter about the periphery of the drill bit. The gauge 224 thus determines the minimum diameter of the resulting borehole that the drill bit 210 will produce. The gauge 224 of a small drill bit may be as small as a few centimeters and the gage of an extremely large drill bit may approach a meter or more. Between each blade 216, the drill bit 150 typically includes fluid slots or passages 226 to which the drilling fluid is fed by the nozzles 222.

Each blade profile is shown to include a cone section (such as section 230*a*), a nose section (such as section 230*b*) and a shoulder section (such as section 230*c*). Each such section further contains one or more cutters. For example, the cone section 230*a* is shown to include cutters 232*a*, the nose section 230*b* is shown to contain cutters 232*b* and the shoulder section 230*c* is shown to contain cutters 232*c*. Each blade profile terminates proximate to a drill bit center 215. The center 215 faces (or is in front of) the bottom of the wellbore 110 (FIG. 1) ahead of the drill bit 150 during drilling of the wellbore. Each cutter has a cutting surface, such as cutting surface 216*a* that engages the rock formation when the drill bit 150 is rotated during drilling of the wellbore. Each cutter has a back rake angle and a side rake angle that in combination define the depth of cut of the cutter into the rock formation and its aggressiveness. Each cutter also has a maximum depth of cut into the formation. In one aspect, cutters on at least one section of the blade profile are offset from the cutters on another section of the blade profile. For example, cutters on a cone section may be offset from the cutters on the nose section and shoulder sections. Various offset configurations are described in reference to FIGS. 3A-3C and FIGS. 4-7.

Figure 3A:
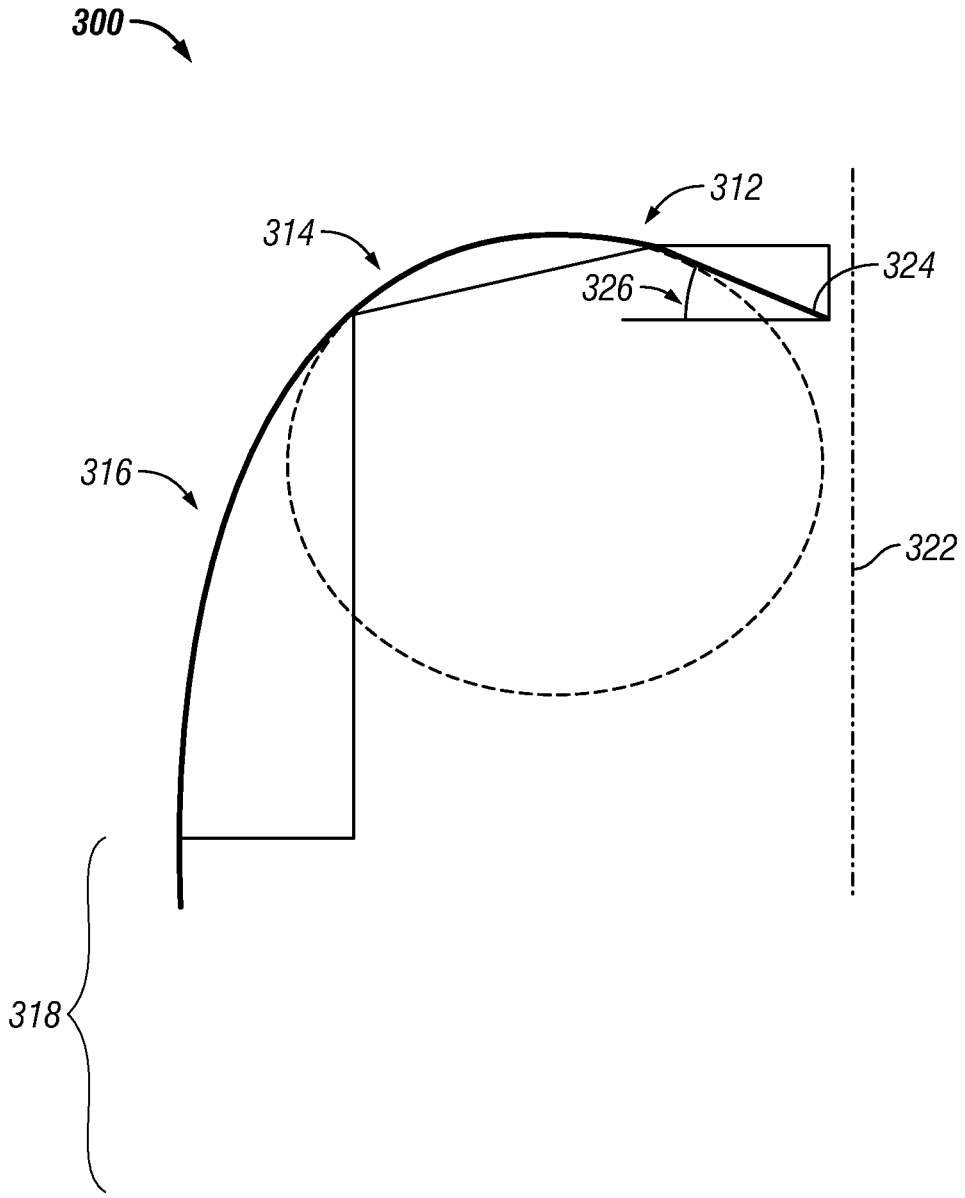
FIG. 3A is a schematic diagram of an exemplary blade profile of a PDC drill bit.

For ease of understanding of the various embodiments disclosed herein, a description of the functions of various sections of a typical blade profile of a PDC drill bit along with commonly used categories of blade profiles is considered useful. FIG. 3A is a partial elevation view of an exemplary blade profile 300 of a PDC drill bit 310. PDC drill bits typically have three or more blade sections that serve related and overlapping functions. The blade profile 300 is shown to include a cone section 312, nose section 314, shoulder section 316 and gauge section 318. The cone section 312 is typically a substantially linear section extending outward from near a center line 322 of the drill bit 310. Because the cone section 312 is nearest the center line 322 of the drill bit 310, its movement relative to the earth formation is less compared to the nose section 312 or the shoulder section 316. The slope and length of the cone section 312 commonly influences lateral stability of the bit 310. The nose section 314 represents the lowest point on a drill bit. Therefore, the cutter(s) on the nose section 314 is typically the leading most cutters. The nose section 314 for the purpose of this disclosure is roughly defined by a nose radius, such as radius 320. A larger nose radius provides more area to place cutters in the nose section. The nose section 314 begins where the cone section 312 ends and it extends to the beginning of the curvature of the shoulder section 316. Thus, the nose section 314 extends to the point where the blade profile tangentially matches a circle formed by the nose radius 320. The nose section 314 experiences larger and more rapid relative movement compared to the cone section 312. Additionally, the nose section 314 typically takes more weight-on-bit than the cone section 312 and shoulder section 316. As such, the nose section 314 experiences much more wear than does the cone section. The nose section is also a more significant contributor to rate of penetration and drilling efficiency than the cone section.

Still referring to FIG. 3A, the shoulder section 316 begins where the blade profile departs from the nose radius 320 and continues outwardly on the blade profile 300 to a point where a slope of the blade profile 320 is essentially vertical. The shoulder section 316 experiences greater and more rapid movement than the cone section 312. Additionally, the shoulder section 316 typically is subjected to substantial dynamic dysfunctions, such as bit whirl and oscillations. As such, the shoulder section 316 experiences greater wear than the cone section 312. The shoulder section 316 is also a more significant contributor to rate of penetration and drilling efficiency than the cone section 316. The gauge section 318 begins where the shoulder section 316 ends. The gauge section 318 typically does not have cutters thereon.

Figure 3B:
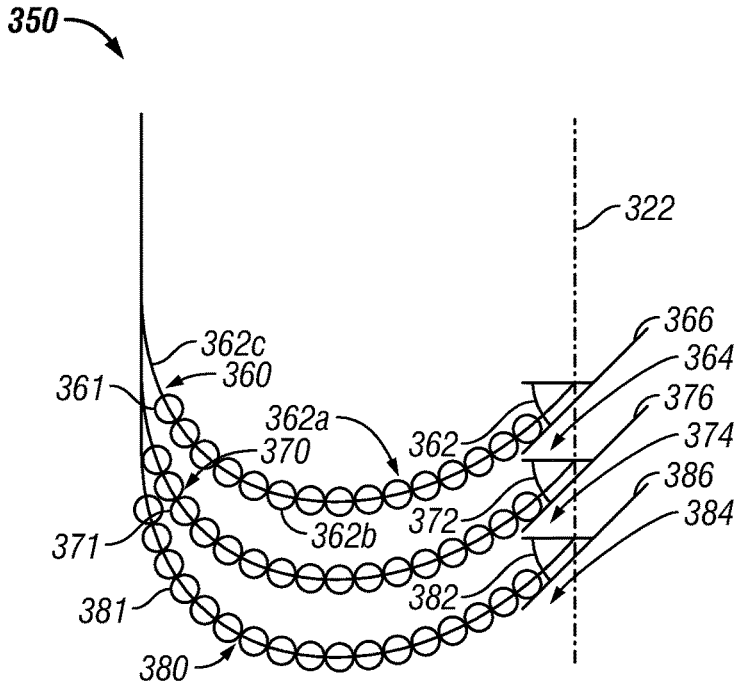
FIG. 3B is a schematic diagram showing examples of short, medium and long profiles of PDC bits.

Blade profiles of a particular PDC drill bit are generally configured based, at least in part, on the desired rate of penetration and lateral stability of the drill bit. The PDC blade profiles may generally be classified or categorized as short profile, medium profile and long profile. FIG. 3B is a schematic diagram of a section of an exemplary drill bit 350 showing a short profile 360, medium profile 370 and long profile 380. Generally, the cone angle 362 of the short profile 360 is less than the cone angle 372 of the medium profile 370 and the cone angle 372 of the medium profile 370 is less than the cone angle 382 of the long profile 380. The slope 386 of the cone section 380 relative to the center-line 322 is greatest for the long profile 380 and least for the short profile 360. As shown in FIG. 3B, the slope 386 of the cone section 380 is greater than the slope 376 of the cone section of the medium profile 370, which slope is greater than the slope 366 of the cone section of the low profile 360. In such a case, the rock volume 384 enclosed by the long profile cone section 380 is greater than the rock volume 374 of the medium profile 370, which is greater than the rock volume 364 of the low profile 360. Operating the drill bit at the same drill bit rotational speed and weight-on-bit, the short profile 360 drill bit will typically exhibit greater lateral vibrations (lesser stability) than the medium profile drill bit, which will exhibit more lateral vibrations (lesser stability) than the long profile 380 drill bit. Short profile drill bits typically provide a higher rate of penetration than do the medium and long profile drill bits. The rock volume and the slope of the cone section influence the lateral stability of the drill bit. A larger rock volume 384 and greater cone section slope 386 for a long blade profile will generally provide greater lateral stability (fewer lateral vibrations) compared to a smaller rock volume 364 and a smaller slope 366 for the low profile 360 drill bit. The cutters are typically placed along the edge of the blade profile. In FIG. 3B, cutters 361 are shown placed along the blade profile 360, cutters 371 along the blade profile 370 and cutters 381 along the blade profile 380.

Figure 3C:
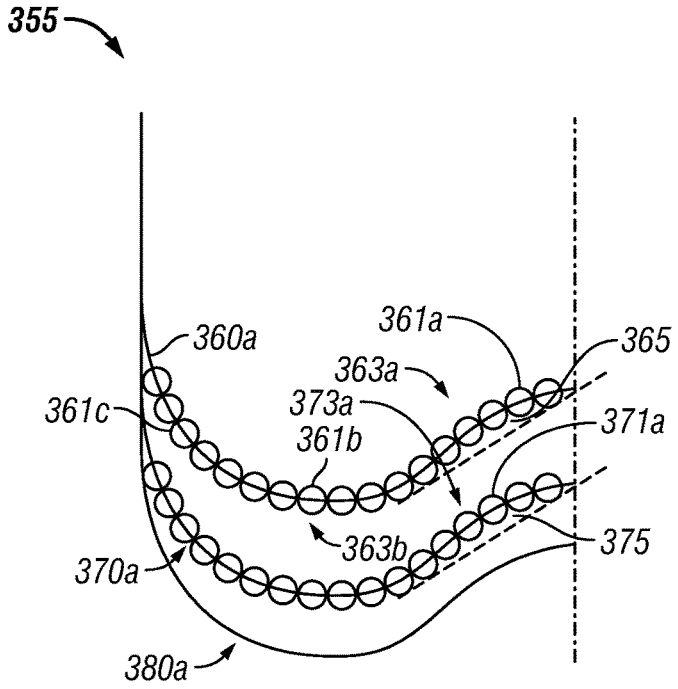
FIG. 3C is a schematic diagram showing examples of short, medium and long profile PDC bits with offset cutters.

FIG. 3C shows a schematic diagram 355 of short profile 360*a*, medium profile 370*a* and long profile 380*a*. In one aspect, the cone section may be provided with a profile that is offset from the profile of the nose section. The cutters placed on the offset cutter profile will be offset from the cutters on the corresponding nose section. With respect to the low profile 360*a*, cutters 361*a* on the cone section 363*a* are shown offset from the cutters 361*b* on the nose section 363*b*. In the particular configuration of FIG. 3C, the cutter profile 363*a* is concave relative to the profile 361*b* and 361*c*. The concave section 363*a* is shown to have an offset 365. Similarly, the cutter profile 371*a* on the cone section 373*a* of the medium profile 370*a* is shown to have an offset 375. Offsetting the concave section increases the rock volume enclosed by the cone section and thus may decrease the lateral vibrations of the drill bit during drilling and therefore increase its lateral stability.

Figure 4:
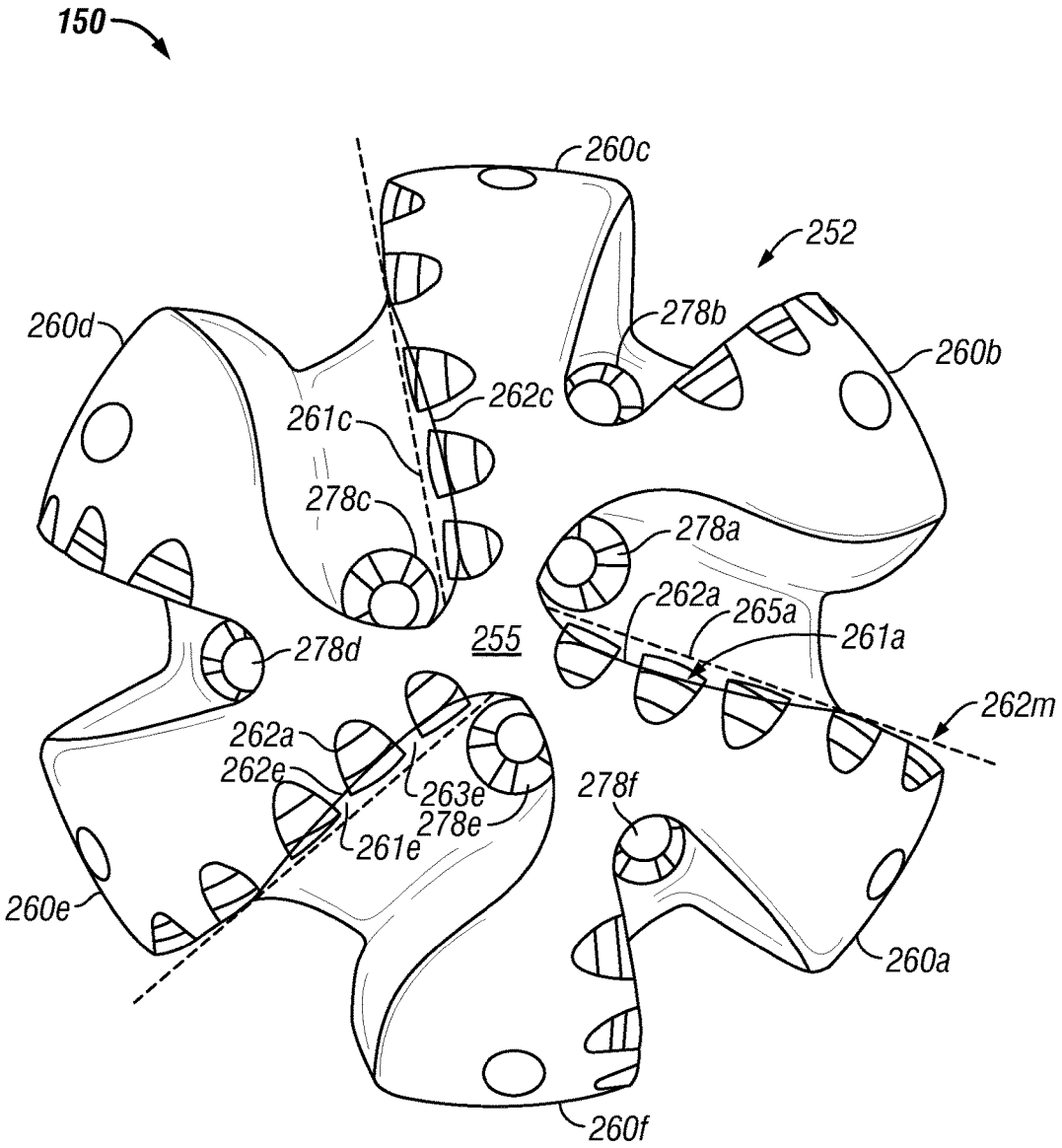
FIG. 4 shows an isometric view of the bottom of the drill bit shown in FIG. 2 with a concave offset for cutters on cone sections of certain blade profiles, according to one embodiment.

FIG. 4 is an isometric view of the bottom of the drill bit shown in FIG. 2 with a concave offset for cutters on cone sections of certain blade profiles, according to one embodiment. FIG. 4 shows cutter profiles 260*a*-260*f*, wherein alternate profiles 260*a*, 260*c* and 260*e* terminate proximate the center 255 of the drill bit 150, while the alternate blade profiles 260*b*, 260*d* and 260*f* respectively terminate on the side of the blade profiles 260*c*, 260*e* and 260*a*. In one aspect, one or more sections of any blade profile may be offset with respect to one or more other sections on that blade profile. As an example, FIG. 4 shows offsets for cone sections 260*a*, 260*c* and 260*e*. The non-offset profiles for the cone sections are denoted by dotted lines 261*a*, 261*c* and 261*e* respectively. The corresponding offset profiles are shown by lines 262*a*, 262*c* and 262*e* respectively. In the particular example of FIG. 4, the offset is obtained by providing a concave cone section. The size of cutters may vary from one cutter to another or with respect to a certain number of cutters in one section compared to another section. In one aspect, the offset may be defined by the distance between the non-offset line and the offset line, such as the distance 263 between the lines 261*e* and 262*e* for cutter profile 260*e*. Alternatively, the offset may be defined by the offset distance between a cutter element of one section relative to a cutter on another section, such as distance 265*a* between a cutter 269*a* on the offset section and a cutter 269*b* on a non-offset section. Any other method may be used for defining the offset for the purpose of this disclosure. Also, any other suitable profile may be used for providing an offset.

Figure 5:
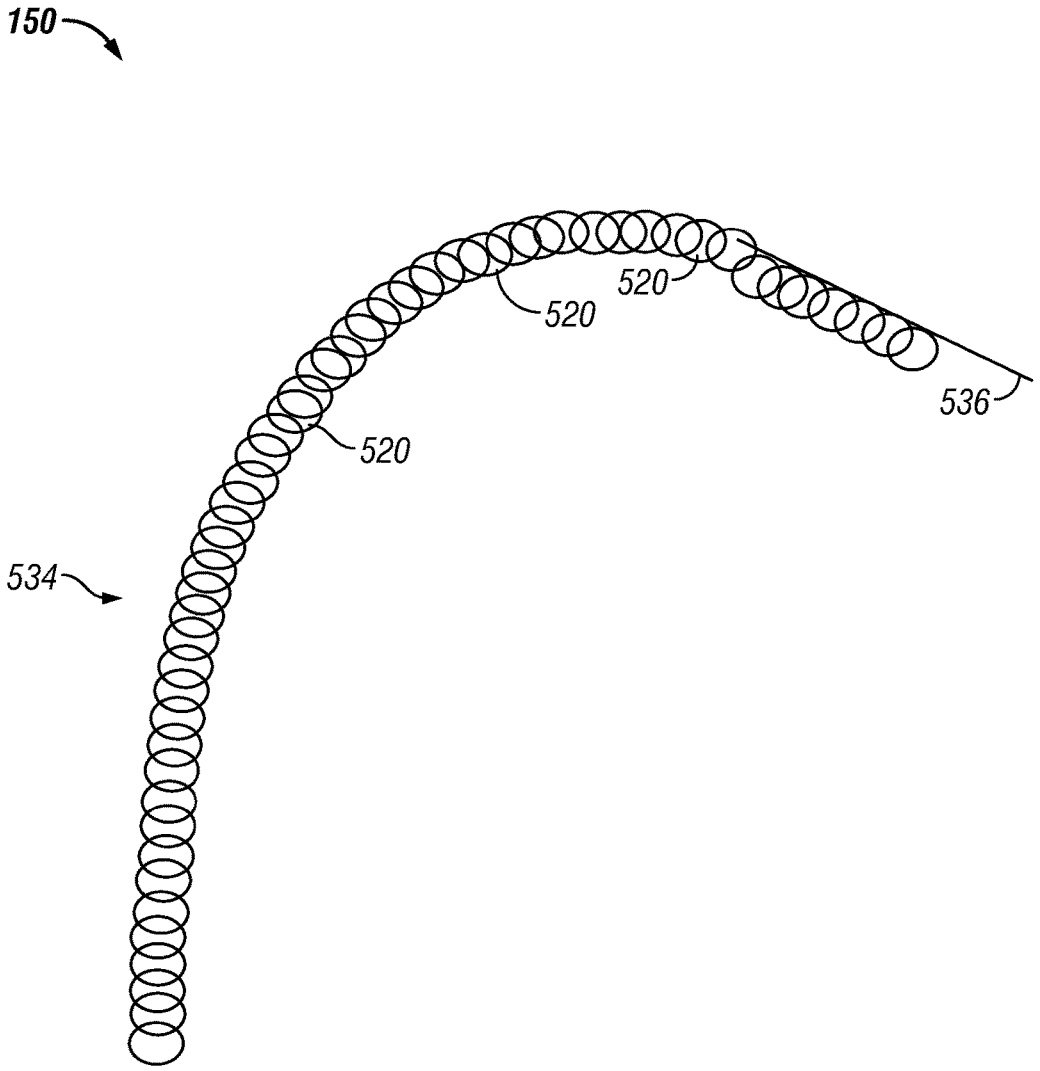
FIG. 5 is an elevation view of multiple cutter profiles of a drill bit according to one aspect of the disclosure.
Figure 6:
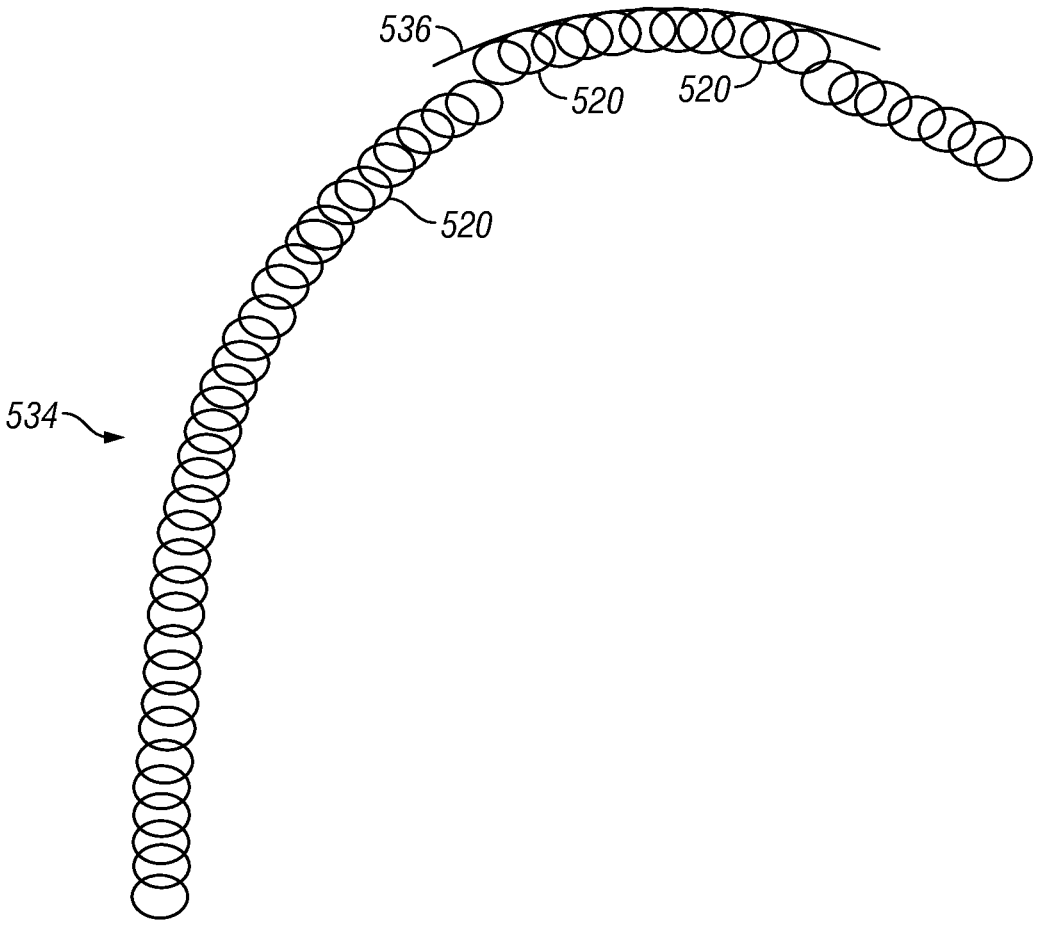
FIG. 6 is another elevation view of multiple cutter profiles of a drill bit according to another aspect of the disclosure.
Figure 7:
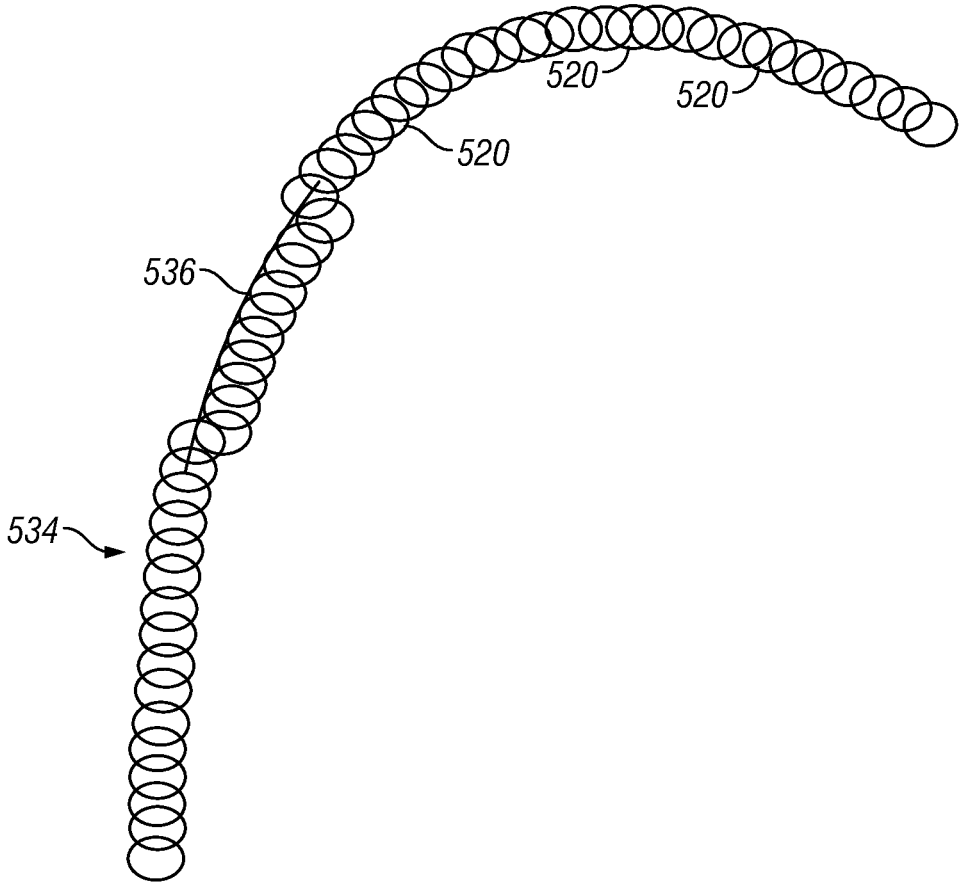
FIG. 7 is yet another elevation view of multiple cutter profiles of a drill bit according to yet another aspect of the disclosure.

FIG. 5 shows an example of another offset profile. In the configuration of FIG. 5, the bit 150 may have a first cutter profile 534 and a second cutter profile 536 offset from the first cutter profile 534. As shown in FIGS. 5-7, the second cutter profile 536 may be offset inwardly or outwardly from the first cutter profile 534. In one aspect, the second cutter profile 536 may be offset from the first cutter profile by any desired amount, including offsets ranging from 0.020 inches and 0.2 inches, or more. In one aspect a second cutter profile 536 may be offset from the first cutter profile 534 by approximately 0.15 inches. For example, the second cutter profile 536 may be offset from the first cutter profile 534 by a selected percentage of the cutter diameter. For example, the second cutter profile 536 may be offset from the first cutter profile 534 by between twenty-five and seventy-five percent of the diameter of the cutting elements 520 of the first profile 534, the second profile 536 or an average thereof. In one embodiment, the second cutter profile 536 may offset from the first cutter profile 534 by approximately 50% of the diameter of the cutting elements 520 of the first profile 534.

The second cutter profile 536 may be located along the cone, nose, and/or shoulder sections. In one aspect, the second cutter profile 536 may span more than one adjacent section, such as the cone and nose sections, and/or may span two or more non-adjacent sections, such as the cone and shoulder sections, with the first cutter profile 534 being located along the remaining sections. The second cutter profile 536 may comprise a plurality of the cutting elements 520. The second cutter profile 536 may or may not comprise all of the cutting elements 520 in the affected section, or sections. For example, the second cutter profile 536 may comprise between five and one hundred percent of the cutting elements 520 in the affected section or sections. In one embodiment, the second cutter profile 536 may comprise approximately all of the cutters 520 in the cone section. In another embodiment, the second cutter profile 536 may comprise approximately 75% of the cutters 520 in the nose section. In another embodiment, the second cutter profile 536 may comprise approximately 50% of the cutters 520 in the shoulder section. In any case, as also shown in FIG. 5, FIG. 6, and FIG. 7, the second cutter profile 536 may comprise fewer cutting elements 520 than the first cutter profile 534. Alternatively, the second cutter profile 536 may comprise roughly the same number or more cutting elements 520 than the first cutter profile 534. In one embodiment, a certain number of cutters in the first profile 534 may comprise approximately forty cutting elements, while the second cutter profile comprises approximately ten cutting elements. The second cutter profile 536 may comprise a percentage of the cutting elements 520, such as ten, fifteen, or twenty percent. Alternatively, the second cutter profile 536 may comprise a fraction of the cutting elements 520, such as one-quarter, one-third, or one-half.

Other and further embodiments utilizing one or more aspects of the disclosure described herein may be devised without departing from the spirit of the disclosure herein. For example, the cutting elements 520 in each profile may be identical. Alternatively, the cutting elements 520 may be differently sized, shaped, and/or constructed. Additionally or alternatively, the drill bit 150 may include three or more cutter profiles, with each being inwardly or outwardly and located in any of the blade sections. Further, the various methods and embodiments of the disclosure herein may be included in combination with each other to produce variations of the disclosed methods and embodiments.

Thus, in one aspect a drill bit is provided that may include at least one blade profile, at least one first cutter or cutting element on a first section of the blade profile offset from at least one second cutter or cutting element on a second section of the blade profile. In one aspect, the first section is a cone section of the blade profile and the at least one first cutter is offset inwardly, relative to the at least one second cutter. In one aspect, the cone section may include a concave section and the at least one first cutting element may be disposed on the concave section. In another aspect, the cutters on the cone section may be offset outwardly relative to one of the nose section and the shoulder section. In one embodiment, the first section is at least a portion of a shoulder section and wherein the at least one first cutting element is offset relative to the at least second cutting element on one of a cone section and nose section. In another aspect, the at least one first cutting element may include a plurality of cutting elements on one of the cone section, nose section and shoulder section. In one aspect, the at least one first cutting element may be larger in size than the at least one second cutting element.

In another embodiment, a drill bit may include a plurality of blade profiles, each blade profile including a cone section, a nose section and a shoulder section, wherein at least a portion of one of the cone section, nose section and shoulder section is offset relative to one of the cone section, nose section and shoulder section, and at least one cutting element on each of the cone section, nose section and shoulder section. In another embodiment, the drill bit may include a bit body having a central axis, a plurality of blade profiles, each blade profile including a cone section that terminates toward the central axis, wherein each cone section is offset relative to the nose section so as to provide a greater volume between the plurality of the cone sections and the central line compared to each such cone section without an offset; and at least one cutting element on each of the cone sections configured to cut into a formation. In one aspect, each cone section may include a concave section that defines the offset. In another aspect, the offset may be chosen based on a simulation that provides greater lateral stability of the drill bit with the selected offset compared to the lateral stability of a corresponding drill bit without the offset.

In another aspect, a method of making a drill bit is provided, which method may include providing a bit body, forming a plurality of blade profiles on the bit body, with each blade profile having a first section that is offset from a second section, and forming at least one cutting element on the first section and the second section. The first section of each blade profile may include a cone section that includes a concave section relative to the second section. The offset may be selected based on results from a simulation model that defines lateral stability of the drill bit with the selected offset to be greater than the lateral stability of a substantially similar drill bit without the offset.

In another aspect an apparatus for use in a wellbore is provided that in one embodiment may include a tool body, a drill bit attached to a bottom end of the tool body, wherein the drill bit further includes a bit body including at least one blade profile, and at least one first cutting element on a first section of the blade profile that is offset from at least one second cutting element on a second section of the blade profile. The apparatus may further include one or more sensors configured to provide information relating to a parameter of interest. The apparatus may further include a drilling motor configured to rotate the drill bit.

The foregoing disclosure is directed to certain specific embodiments of a drill bit, methods of making such drill bits and a system for drilling wellbores utilizing such drill bits for explanation purposes. Various changes and modifications to such embodiments, however, will be apparent to those skilled in the art. All such changes and modifications are intended to be a part of this disclosure and within the scope of the appended claims.

The invention claimed is:

1. A drill bit comprising:

a bit body including a plurality of blades, wherein the blades alternate between terminating proximate a center of the drill bit and terminating proximate a side of the drill bit, each of the blades terminating proximate the center of the drill bit including a cone section, a nose section and a shoulder section;

wherein, for each blade terminating proximate the center of the drill bit:

cutters of at least one of the nose section and the shoulder section are aligned along a first blade profile, wherein the first blade profile defines a non-offset line that is tangential to the first blade profile in the cone section, and cutters of the cone section are aligned along a second blade profile, wherein the second blade profile is concave with respect to the non-offset line.

2. The drill bit of claim 1, wherein, for each blade terminating proximate the center of the drill bit, cutters of the nose section are aligned along the first blade profile and the cutters of the shoulder section are aligned along the second blade profile and the second blade profile is offset inwardly relative to the first blade profile.

3. The drill bit of claim 1, wherein cutters of at least a portion of a shoulder section are aligned along the first blade profile.

4. The drill bit of claim 1, wherein the cutters of the one of the cone section, the nose section and the shoulder section includes at least one first cutting element and the cutters of the other of the cone section, the nose section and the shoulder section includes at least one second cutting element, wherein the at least one first cutting element of is greater in size than the at least one second cutting element.

5. A drill bit comprising:

a plurality of blades, wherein the blades alternate between terminating proximate a center of the drill bit and terminating proximate a side of the drill bit, wherein each of the blades terminating proximate the center of the drill bit includes a cone section, a nose section and a shoulder section, and cutters of at least one of the nose section and the shoulder section are aligned along a first blade profile, wherein the first blade profile defines a non-offset line that is tangential to the first blade profile in the cone section, and cutters of the cone section are aligned along a second blade profile, wherein the second blade profile is concave with respect to the non-offset line.

6. A drill bit comprising:

a bit body having a central axis;

a plurality of blades on the bit body, wherein the blades alternate between terminating proximate a center of the drill bit and terminating proximate a side of the drill bit, each of the blade profiles terminating proximate the center of the drill bit including a cone section, a nose section and a shoulder section, wherein for each blade terminating proximate the drill bit:

cutters of at least one of the nose section and the shoulder section are aligned along a first blade profile, wherein the first blade profile defines a non-offset line that is tangential to the first blade profile in the cone section, and cutters of the cone section are aligned along a second blade profile, wherein the second blade profile is concave with respect to the non-offset line.

7. A method of making a drill bit, comprising:

providing a bit body;

forming a plurality of blades on the bit body, wherein the plurality of blades alternate between terminating proximate a center of the drill bit and terminating proximate a side of the drill bit, with each blade that terminates proximate the center of the drill bit having a cone section, a nose section and a shoulder section and cutters of at least one of the nose section and the shoulder section are aligned along a first blade profile, wherein the first blade profile defines a non-offset line that is tangential to the first blade profile in the cone section, and cutters of the cone section are aligned along a second blade profile, wherein the second blade profile is concave with respect to the non-offset line.

8. The method of claim 7, further comprising selecting an offset between the first blade profile and a second blade profile based on results from a simulation model that indicates that lateral stability of the drill bit with the offset is greater than lateral stability of the drill bit without the offset.

9. The method of claim 7, wherein for each blade that ends proximate the center of the drill bit, the nose section is aligned along the first blade profile and the shoulder section is aligned along the second blade profile and the second blade profile is offset inwardly relative to the first blade profile.

10. An apparatus for use in drilling through a formation, comprising:

a tool body; and a drill bit attached to a bottom end of the tool body, wherein the drill bit further comprises:

a bit body including a plurality of blades wherein the plurality of blades alternate between terminating proximate a center of the drill bit and terminating proximate a side of the drill bit, each blade terminating proximate the center of the drill bit including:

a cone section, a nose section and a shoulder section, wherein cutters of at least one of the nose section and the shoulder section are aligned along a first blade profile that defines a non-offset line that is tangential to the first blade profile in the cone section, and cutters of the cone section are aligned along a second blade profile, wherein the second blade profile is concave with respect to the non-offset line.

11. The apparatus of claim 10, wherein for each blade that ends proximate the center of the drill bit, the nose section is aligned along the first blade profile and the shoulder section is aligned along the second blade profile and the second blade profile is offset inwardly relative to the first blade profile.

12. The apparatus of claim 10 further comprising at least one sensor configured to provide information relating a parameter of interest.

* * * * *